US008329629B2

(12) United States Patent
Park et al.

(10) Patent No.: US 8,329,629 B2
(45) **Date of Patent: *Dec. 11, 2012**

(54) LIQUID COMPOSITION TO CLEAN NOZZLE SURFACE AND CLEANING DEVICE HAVING THE SAME

(75) Inventors: Heung-sup Park, Suwon-si (KR); Seung-min Ryu, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 648 days.

This patent is subject to a terminal disclaimer.

(21) Appl. No.: 12/404,375

(22) Filed: Mar. 16, 2009

(65) Prior Publication Data

US 2009/0237445 A1 Sep. 24, 2009

(30) Foreign Application Priority Data

Mar. 18, 2008 (KR) ..... 10-2008-0024873

(51) Int. Cl.
*C11D 3/28* (2006.01)
*C11D 3/44* (2006.01)

(52) U.S. Cl. ..... 510/170; 510/499; 510/505

(58) Field of Classification Search ..... 347/95, 347/96, 100, 20, 28; 510/170, 212, 499, 510/505

See application file for complete search history.

(56) References Cited

U.S. PATENT DOCUMENTS

| | | | | | |
|---|---|---|---|---|---|
| 4,055,515 | A * | 10/1977 | Kirch | 430/331 |
| 4,749,510 | A * | 6/1988 | Nelson | 510/212 |
| 5,458,660 | A * | 10/1995 | Lin et al. | 548/551 |
| 6,121,228 | A * | 9/2000 | Drapier et al. | 510/417 |
| 2010/0091066 | A1 * | 4/2010 | Lee et al. | 347/28 |

* cited by examiner

*Primary Examiner* — Brian P Mruk
(74) *Attorney, Agent, or Firm* — Stanzione & Kim, LLP

(57) ABSTRACT

A liquid composition to clean an inkjet nozzle, and a inkjet head cleaning unit that contains the same. The liquid composition includes an inkjet ink stabilizer capable of removing impurities from an inkjet nozzle.

8 Claims, 3 Drawing Sheets

LIQUID COMPOSITION TO CLEAN NOZZLE SURFACE AND CLEANING DEVICE HAVING THE SAME

CROSS-REFERENCE TO RELATED APPLICATIONS

This application claims the benefit of Korean Patent Application No. 10-2008-0024873, filed on Mar. 18, 2008, in the Korean Intellectual Property Office, the disclosure of which is incorporated herein in its entirety by reference.

BACKGROUND OF THE INVENTION

1. Field of the Invention

The present general inventive concept relates to a liquid composition to clean a nozzle of an inkjet printer, and more particularly, to a liquid composition to remove impurities from a nozzle surface of an inkjet printer, and a cleaning unit using the same.

2. Description of the Related Art

Recently, as demands for inkjet printers have continuously increased, many research studies have been conducted to improve the printing quality and reduce the manufacturing costs of such printers. Inkjet printers are used in a wide range of applications, including advertisement broadcasting industries or advertisement businesses.

As for image processing, a variety of methods of colorizing a hard copy are developed due to high demand for colored hard copies. Such methods include a dye-sublimation printing method, a thermal wax transfer printing method, an inkjet printing method, an electrophotographic printing method, and a thermally processed silver printing method.

In the inkjet printing method, an ink droplet is ejected from a nozzle of a printing head of an inkjet printer on a printing medium, such as paper sheet, thereby forming dots which form letters or images. The inkjet printing method is less expensive than other printing methods and high-quality color images can be printed using this method. Ink used in the inkjet printing method is prepared by dissolving or dispersing water-soluble dye or pigment in a solvent including water and a water-soluble organic solvent. When required, the ink may further include a surfactant.

Inkjet printers which are operated using the inkjet printing method can be categorized into a piezoelectric-type inkjet printer which ejects ink using a piezoelectric device and a thermal-type inkjet printer which ejects ink using a thermal device, according to a method of ejecting ink droplets.

Meanwhile, ink contained in an ink chamber of an inkjet printer head is locally evaporated by a heating device to generate bubbles, and thus an ink droplet in the ink chamber is ejected on a printing medium through an orifice, such as a nozzle. Therefore, a thermal-type inkjet printer includes an inkjet printer head, including a heating device which heats ink and is positioned in the ink chamber, and an operating circuit, such as a logic integrated circuit, operating the heating device.

Much research into ink is being carried out to improve an output speed of inkjet printers and the clarity and brightness of an image. For example, a pigment ink can be used for inkjet printing to increase the printing speed, to obtain a clear color, and to improve waterfastness of black ink. Pigment ink and dye ink should dry quickly on a paper medium. However, quick drying may cause clogging in an inkjet printer head. Specifically, clogging can be caused by ink, dust, or paper. A solid material formed by clogging a nozzle surface cannot be removed and may affect the quality of a printed image. Such clogging is referred to as "nozzle clogging." When nozzle clogging or nozzle wetting occurs, ink ejection is hindered and thus the ejection speed of ink is decreased and it is difficult for an ink droplet to be ejected.

However, conventional methods of removing impurities from a nozzle surface do not entirely remove impurities remaining on the nozzle surface and use a general cleaning composition. Therefore, an optimized cleaning function cannot be obtained.

SUMMARY OF THE INVENTION

The present general inventive concept provides a liquid composition to clean a nozzle surface, which can effectively remove impurities from the nozzle surface in order to obtain long-term inkjet droplet ejection stability.

The present general inventive concept also provides an inkjet recording apparatus including a cartridge containing the liquid composition.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a liquid composition to clean a nozzle surface, the liquid composition including a solvent and a cyclic amid-based compound, wherein a content of the cyclic amid-based compound is in a range of 0.1 to 20 parts by weight based on 100 parts by weight of the liquid composition, and a viscosity of the liquid composition is in a range of 1.5 to 20 cps.

The cyclic amid-based compound is represented by Formula 1:

<Formula 1>

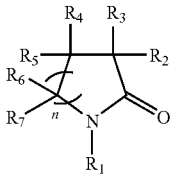

where $R_1$, $R_2$, $R_3$, $R_4$, $R_5$, $R_6$ and $R_7$ are each independently hydrogen, halogen, a carboxylic group, a cyano group, an amino group, substituted or unsubstituted C1-C20 alkyl group, substituted or unsubstituted C1-20 alkoxy group, substituted or unsubstituted C2-20 alkenyl group, substituted or unsubstituted C2-20 alkynyl group, substituted or unsubstituted C1-20 heteroalkyl group, substituted or unsubstituted C6-C30 aryl group, or substituted or unsubstituted C4-30 heteroaryl group; and n is an integer of 1 to 3.

The cyclic amid-based compound may include at least one compound selected from the group consisting of 2-pyrrolidone, 1-methyl-2-pyrrolidone, and N-2-hydroxyethyl-2-pyrrolidone.

A pH of the liquid composition may be in a range of 6 to 10.

The solvent may be a water-based solvent, an organic solvent, or a mixture thereof.

The organic solvent comprises at least one compound selected from the group consisting of an alcohol-based solvent, a ketone-based solvent, an ester-based solvent, a polyhydric alcohol-based solvent, a nitrogen-containing solvent, dimethyl sulfoxide, tetramethyl sulfone, and a sulfur-containing compound of thioglycol.

The solvent may be a solvent mixture including 100 parts by weight of a water-based solvent and 0.1 to 130 parts by weight of an organic solvent.

A surface tension of the liquid composition may be in a range of 15 to 73 dyne/cm at a temperature of 20° C.

The foregoing and/or other aspects and utilities of the present general inventive concept may also be achieved by providing an inkjet recording apparatus including a cleaning unit containing the liquid composition described above.

The foregoing and/or other aspects and utilities of the present general inventive concept may also be achieved by providing a nozzle cleaning device, including an outer housing to reciprocate along a guide rail of an image forming apparatus and along a length of an inkjet head containing a plurality of nozzles; and an inner housing disposed within the outer housing, the inner housing including a flexible bag containing a liquid composition to clean nozzles of the inkjet head, an ultrasonic sensor to vibrate the liquid cleaning composition contained within the flexible bag to shake the flexible bag such that when the outer housing is disposed adjacent to nozzles of the inkjet head, the inner housing raises the flexible bag to contact the nozzle.

The inner housing may further include an operating motor to rotate when the inner housing is disposed adjacent to a nozzle and a cam shaft to raise the inner housing such that the flexible bag contacts the adjacent nozzle when the operating motor rotates.

The nozzle cleaning unit may further include a flexible bag cleaning unit including: a chamber containing a liquid cleaning solution; and a spray head including at least one spray hole to spray the liquid cleaning solution from the chamber onto the flexible bag to remove stains on the flexible bag due to the cleaning of the nozzles.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
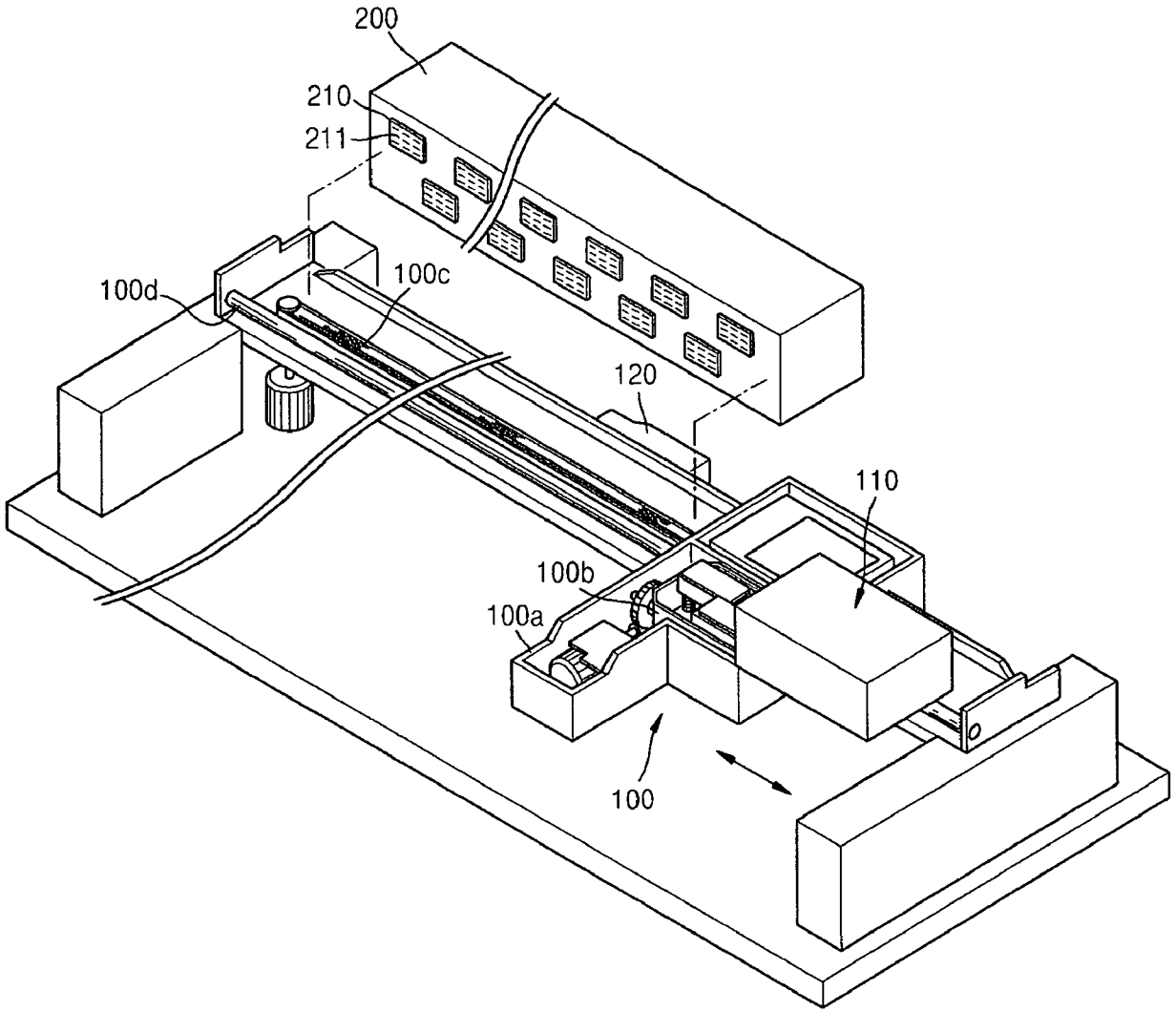
FIG. 1 is a view of an inkjet printer including a nozzle cleaning device according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The present general inventive concept provides a liquid composition to clean a nozzle surface. The liquid composition effectively removes impurities generated in a printing process from the nozzle surface. Therefore, ink droplets can be stably ejected from a printer head for a long period of time and thus, a long lifetime and low maintenance costs can be obtained. Specifically, the liquid composition is sprayed or coated on the surface of a nozzle, and then impurities on the nozzle surface are removed with a physical force of a blade.

The liquid composition to clean a nozzle surface according to an embodiment of the present general inventive concept includes a solvent and a cyclic amid-based compound. The cyclic amid-based compound may be represented by Formula 1:

<Formula 1>

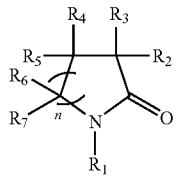

where $R_1$, $R_2$, $R_3$, $R_4$, $R_5$, $R_6$and $R_7$are each independently hydrogen, halogen, a carboxylic group, a cyano group, an amino group, a substituted or unsubstituted C1-C20 alkyl group, a substituted or unsubstituted C1-20 alkoxy group, a substituted or unsubstituted C2-20 alkenyl group, a substituted or unsubstituted C2-20 alkynyl group, a substituted or unsubstituted C1-20 heteroalkyl group, a substituted or unsubstituted C6-C30 aryl group, or a substituted or unsubstituted C4-30 heteroaryl group, and n is an integer of 1 to 3.

For example, the cyclic amid-based compound represented by Formula 1 is 2-pyrrolidone, 1-methyl-2-pyrrolidone, or N-(2-hydroxyethyl)-2-pyrrolidone, but is not limited thereto. In addition, the compounds described above can be used in combination.

In the cyclic amid-based compound, a nitrogen atom of an amide moiety has a positive charge. The positive charge of the nitrogen atom interacts with and is electrically combined with a negative charge of an ink residual on the nozzle surface and thus, the ink residual is dissolved. Therefore, the ink residual can be efficiently removed.

The content of the cyclic amid-based compound may be in a range of 0.1 to 20 parts by weight, specifically 1 to 10 parts by weight, based on 100 parts by weight of the liquid cleansing composition. When the content of the cyclic amid-based compound is less than 0.1 parts by weight, the ink residual may not be removed because the concentration of the ink residual is high, and thus, a sufficient cleaning effect cannot be obtained. On the other hand, when the content of the cyclic amid-based compound is greater than 20 parts by weight, the dissolving capability of the liquid composition may be degraded and the nozzle surface may be damaged.

The viscosity of the liquid composition to clean a nozzle surface according to an embodiment of the present general inventive concept may be equal to or smaller than the viscosity of ink used in an inkjet printing process. This is because when the viscosity of the liquid composition is lower than that of ink, the viscosity of the ink residual having a high concentration and the viscosity of ink itself can be reduced and a cleaning capability of the liquid composition can be enhanced. The viscosity of the liquid cleansing composition may be in a range of 1.5 to 20 cps. When the viscosity of the liquid composition is less than 1.5, it would be difficult to spray the liquid composition on a head chip, and even when the liquid composition is sprayed, the liquid composition may easily evaporate. On the other hand, when the viscosity of the liquid composition is greater than 20 cps, the liquid composition may be incompletely removed from the surface of a head chip and can also permeate into the nozzle, thereby contaminating ink.

The liquid composition to clean a nozzle surface according to an embodiment of the present general inventive concept may have a predetermined pH range. For example, the pH of the liquid composition may be 2 greater or smaller than the pH of ink used in the inkjet printing process. Specifically, the pH of the liquid composition may be in a range of 6 to 10. When the pH of the liquid composition is smaller than 6, ink may precipitate due to a strong acid condition. On the other hand, when the pH of the liquid composition is greater than 10, the liquid composition may react with ink.

The solvent of the liquid composition to clean a nozzle surface according to an embodiment of the present general inventive concept may be a water-based solvent, an organic solvent, or a mixture thereof. The content of the solvent may be in a range of 70 to 99.9 parts by weight based on 100 parts by weight of the liquid composition. When the content of the solvent is less than 70 parts by weight, the viscosity of the liquid composition may be too high and the content of an active material is high, and thus the liquid composition may affect properties of ink inside the nozzle. On the other hand, when the content of the solvent is greater than 99.9 parts by weight, the cleaning capability of the liquid cleansing composition may be degraded, and thus the liquid composition cannot act as a cleaning solution.

The water-based solvent may be water. The organic solvent may include at least one solvent selected from the group consisting of an alcohol-based solvent, a ketone-based solvent, an ester-based solvent, a polyhydric alcohol-based solvent or a derivative thereof, a nitrogen-containing solvent, dimethyl sulfoxide, tetramethyl sulfone, and a sulfur-containing compound of thioglycol. For example, the mono valent alcohol-based solvent may control the surface tension of ink so as to improve permeability of ink into a recording medium, such as a general sheet or a sheet designed for specific purposes, a dot forming ability of ink, and a dry characteristic of a printed image. The polyhydric alcohol-based solvent or the derivative thereof may not easily evaporate and reduces the freezing point of ink, and thus, ink becomes more stable and clogging of the nozzle can be prevented.

The mono valent alcohol-based solvent may be a low alcohol, such as methyl alcohol, ethyl alcohol, n-propyl alcohol, i-propyl alcohol, n-butyl alcohol, s-butyl alcohol, or t-butyl alcohol, specifically ethyl alcohol, i-propyl alcohol, or n-butyl alcohol. The polyhydric alcohol-based solvent may be alkyleneglycols, such as ethyleneglycol, diethyleneglycol, triethyleneglycol, propyleneglycol, butyleneglycol, or glycerol; polyalkyleneglycols, such as polyethyleneglycol or polypropyleneglycol; or thiodigylcol.

The derivative of the polyhydric alcohol-based solvent may be low alkyl ethers of the polyhydric alcohol-based solvent described above, such as ethyleneglycoldimethylether, or low carboxylic acid esters of the polyhydric alcohol-based solvent, such as ethyleneglycoldiacetate. The ketone-based solvent may be acetone, methylethylketone, diethylketone, or diacetonealcohol. The ester-based solvent may be methyl acetate, ethyl acetate, or ethyl lactate.

The nitrogen-containing solvent that can act as the organic solvent may be 2-pyrrolidone or N-methyl-2-pyrrolidone, and the sulfur-containing solvent may be dimethyl sulfoxide, tetramethylene sulfone, or thioglycol.

The solvent mixture may include the water-based solvent and the organic solvent. In this regard, the content of the organic solvent may be in a range of 0.1 to 130 parts by weight based on 100 parts by weight of the water-based solvent. When the content of the organic solvent is less than 0.1 parts by weight, ink may evaporate too quickly and the stability of ink may be degraded. On the other hand, when the content of the organic solvent is grater than 130 parts by weight, the viscosity of ink is increased and the ejection performance may be degraded.

The liquid composition to clean a nozzle surface according to the present general inventive concept may have a surface tension of 15 to 73 dyne/cm, specifically 25 to 55 dyne/cm at 20° C.

The liquid composition according to the present general inventive concept may further include various additives to enhance its characteristics. For example, the liquid composition may include at least one kind of additive selected from the group consisting of a wetting agent, a dispersing agent, a surfactant, a viscosity controller, a pH controller, and an antioxidant. The content of the additive may be in a range of 0.1 to 20 parts by weight, specifically 0.1 to 10 parts by weight, based on 100 parts by weight of the liquid composition.

The substituents used in the compound according to the present general inventive concept may be defined as follows:

The terminology "alkyl group" refers to a linear or branched saturated mono-valent hydrocarbon moiety having 1 to 20 carbons, specifically 1 to 10 carbons, and more specifically 1 to 6 carbons. The alkyl group can be optionally substituted with at least one halogen substituent. The alkyl group may be methyl, ethyl, propyl, 2-propyl, n-butyl, isobutyl, tert-butyl, pentyl, hexyl, dodecyl, fluoromethyl, difluoromethyl, trifluoromethyl, chloromethyl, dichloromethyl, trichloromethyl, iodomethyl, or bromomethyl.

The terminology "alkoxy group" refers to —O-alkyl.

The terminology "aryl group" refers to a mono-valent monocyclic, bicyclic, or tricyclic hydrocarbon moiety having 6 to 30 ring atoms, specifically 6 to 18 ring atoms, which can be optionally substituted with at least one halogen substituent. In the aryl group, an aromatic moiety includes carbon atoms only. The aryl group may be phenyl, naphthalenyl, and fluorenyl.

The terminology "heteroalkyl" or "heteroaryl" refers to an alkyl or aryl group that is obtained by substituting some of ring-forming carbon atoms of the alkyl or aryl group described above with a hetero atom, such as a nitrogen atom, a sulfur atom, a phosphor atom, or an oxygen atom.

A liquid composition to clean a nozzle surface according to the present general inventive concept may be used to form an inkjet cleaning solution unit, alone or together with another type of liquid composition to clean a nozzle surface. The inkjet cleaning solution unit may be provided to a container for a cleaning solution in an inkjet recording apparatus or to a separate inkjet printer cartridge.

An inkjet recording apparatus according to the present general inventive concept may include a thermal-type head in which an ink droplet is ejected by a vapor pressure generated when an ink composition is heated, a piezo-type head in which an ink droplet is ejected by a piezo device, a disposable-type head, or a permanent-type head, specifically the thermal-type head. The inkjet recording apparatus may be a scanning-type printer or an array-type printer, specifically an array-type printer having at least 10,000 nozzles. The inkjet recording apparatus may be used for office work, or in the textile or other industries. However, the cleaning solution according to the present general inventive concept can be used with other head types, printers, or image forming devices.

FIG. 1 is a perspective view of an inkjet recording apparatus including a nozzle cleaning device 100 using a liquid composition, according to an embodiment of the present general inventive concept. However, such an inkjet recording apparatus may also have other structures.

Figure 2:
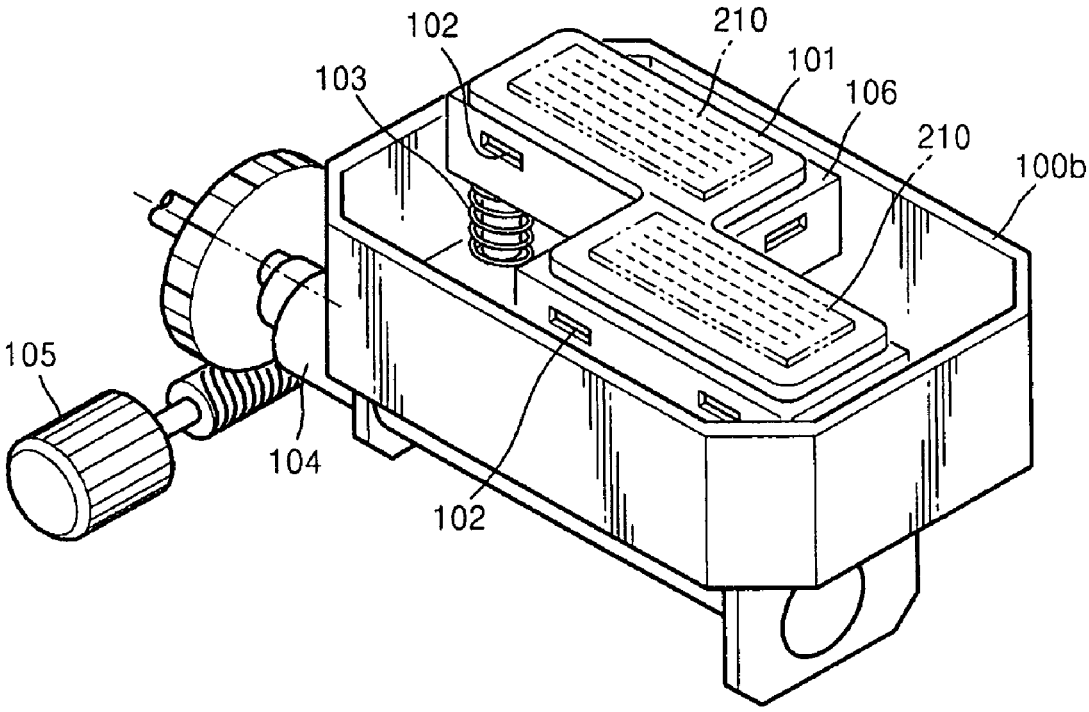
FIG. 2 is a view of the nozzle cleaning device of FIG. 1.

Specifically, FIG. 1 illustrates a schematic structure of an inkjet recording apparatus including the nozzle cleaning device 100, according to an embodiment of the present general inventive concept, and FIG. 2 is an enlarged view of a portion of the inkjet recording apparatus of FIG. 1.

In this regard, an inkjet head 200 performing a printing process is of an array type and includes a plurality of nozzles 210 aligned in a width direction of a printing medium.

The nozzle cleaning device 100 cleans the nozzles 210 of the inkjet head 200. Specifically, according to the present embodiment, a liquid cleaning composition is agitated by a vibration generating device to directly contact a surface of the nozzles 210, and then the liquid cleaning composition on the surface of the nozzles 210 is removed by a blade. Alternatively, a flexible bag 101 containing the liquid cleaning composition can wipe the surface of the nozzles 210 to clean an outlet hole 211.

Specifically, an outer housing 100*a* reciprocates along a guide rail 100*d* when a rotary belt 100*c* operates. An inner housing 100*b* is positioned inside the outer housing 100*a*, and includes the flexible bag 101, an ultrasonic sensor 102 which vibrates the liquid cleaning composition contained in the flexible bag 101 so as to shake the flexible bag 101, and a supporting member 106 which is elastically movable by a buffer spring 103 and on which the flexible bag 101 and the ultrasonic sensor 102 are mounted. The inner housing 100*b* is coupled to a camshaft 104 which eccentrically rotates by an operating motor 105 and elevates according to an eccentric distance when the camshaft 104 rotates. Therefore, when the camshaft 104 rotates, the inner housing 100*b* elevates and the flexible bag 101 contacts or is separated from the surface of the nozzles 210 positioned above the flexible bag 101.

Figure 3:
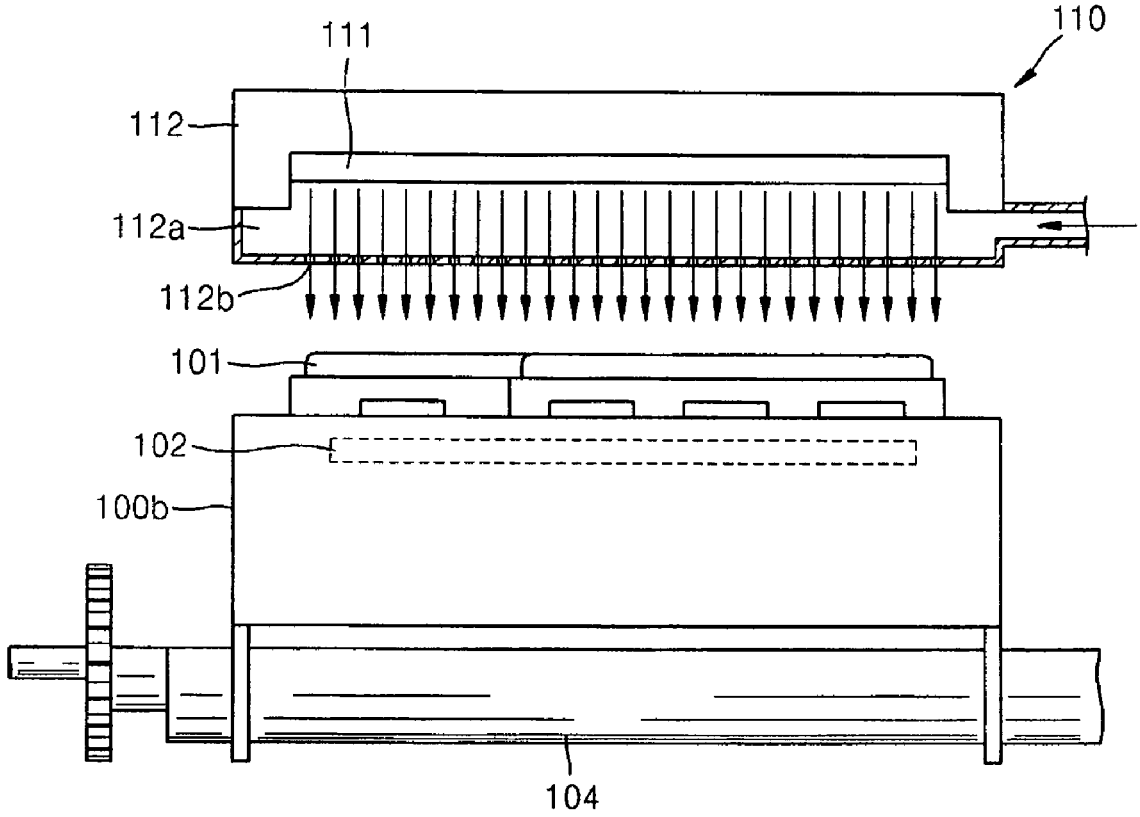
FIG. 3 illustrates a process of cleaning a flexible bag of the nozzle cleaning device of FIG. 1.

Aflexible bag cleaning unit 110 which cleans a surface of the flexible bag 101 is positioned outside the inkjet head 200. Specifically, the flexible bag cleaning unit 110 cleans ink stains made on the flexible bag 101, when the flexible bag 101 wipes the outlet hole 211 of the nozzle 210, with a liquid cleaning solution according to embodiments of the present general inventive concept. The flexible bag cleaning unit 110 includes a spray head 112 which sprays the liquid cleaning solution through a spray hole 112*b* by vibrations generated by an ultrasonic sensor 111, as illustrated in FIG. 3. That is, the liquid cleaning composition filled in a chamber 112*a* is sprayed through the spray holes 112*b* by the vibration generated by the ultrasonic sensor 111 to remove the ink stains on a surface of the flexible bag 101. The sprayed liquid cleaning composition evaporates together with the ink stains. The reference numeral 120 of FIG. 1 denotes a liquid cleaning composition tank 120 which supplies the liquid cleaning composition to the flexible bag cleaning unit 110.

Hereinafter, a method of cleaning using the nozzle cleaning device 110 will be described in detail with reference to FIGS. 1 through 4.

To perform a washing process, the outer housing 100*a* (FIG. 1) is moved in such a way that the flexible bag 101 (FIGS. 2 through 4) is positioned immediate under a target nozzle of the nozzles 210 to be cleaned. In this regard, the outer housing 100*a* moves along the guide rail 100*d* by rotation of the rotary belt 100*c*. Such movement of the outer housing 100*a* is described based on an assumption that an inkjet head is of an array type. If the ink jet head is of a shuttle type, the flexible bag 101 should be positioned above the nozzles 210 to be cleaned.

Figure 4:
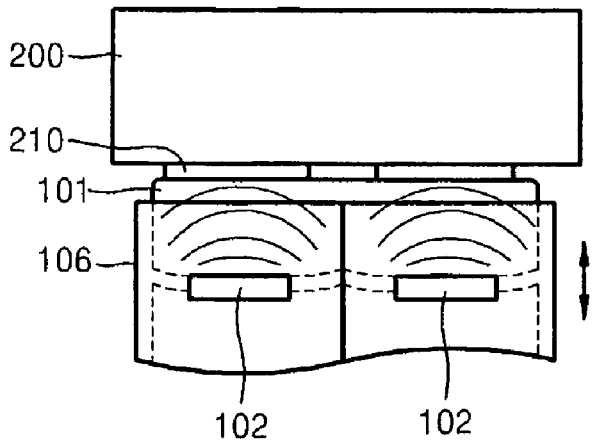
FIG. 4 illustrates a process of operating the nozzle cleaning device of FIG. 1.

Then, when cleaning of the target nozzle begins, the camshaft 104 rotates by the operating motor 105 and the inner housing 100*b* elevates until the flexible bag 101 contacts a surface of the target nozzle of the nozzles 210, as illustrated in FIG. 4. Then, the ultrasonic sensor 102 generates vibrations and thus the liquid cleaning composition filled in the flexible bag 101 starts moving and the flexible bag 101 is shaken thereby. Thus, the flexible bag 101 wipes an outlet pore of the target nozzle of the nozzles 210. In this structure, the cleaning process can be performed without direct contact of the liquid cleaning composition with a nozzle. Therefore, the liquid cleaning composition is not spilled off and there is no need to supply and collect the liquid cleaning composition because the flexible bag 101 which is sealed and filled with the liquid cleaning composition is used.

When the target nozzle is completely cleaned, the rotary belt 100*c* is rotated in such a way that the outer housing 100*a* is positioned to correspond to the next nozzle of the nozzles 210 to be cleaned, and then elevating and vibrating processes are performed.

When all of the nozzles 210 are completely cleaned, the outer housing 100*a* is moved to be under the flexible bag cleaning unit 110. In this state, when the ultrasonic sensor 111 of the spray head 112 is operated as illustrated in FIG. 3, the liquid cleaning composition filled in the chamber 112*a* is sprayed to the flexible bag 101 through the spray hole 112*b*. Then, the sprayed liquid cleaning composition is evaporated together with an ink stain on the flexible bag 101 and the surface of the flexible bag 101 is cleaned. Thus, the nozzle cleaning process using the flexible bag 101 is completed.

Meanwhile, the flexible bag 101 may be any bag that allows external vibrations to be delivered to a fluid filled therein and the motion of the fluid to be delivered to the outside of the bag, such as a plastic bag or a rub bag.

The present general inventive concept will be described in further detail with reference to the following examples. These examples are for illustrative purposes only and are not intended to limit the scope of the present invention.

—Preparation of Nozzle Surface Liquid Cleaning Composition

A liquid composition to clean a nozzle surface were prepared according to the components illustrated in Examples 1 to 3 and Comparative Examples 1 to 3.

EXAMPLE 1

| | |
|---|---|
| Glycerol | 5% by weight |
| Diethyleneglycol | 10% by weight |
| 2-pyrrolidone | 2.5% by weight |
| Surfynol 465 | 1% by weight |
| Water (deionized water) | 81.5% by weight |

EXAMPLE 2

| | |
|---|---|
| Glycerol | 5% by weight |
| Diethyleneglycol | 2% by weight |
| Ethyleneglycol | 3% by weight |
| Surfynol 485 | 0.5% by weight |
| Water (deionized water) | 89.5% by weight |

EXAMPLE 3

| | |
|---|---|
| Glycerol | 10.5% by weight |
| Diethyleneglycol | 4.5% by weight |
| Ethyleneglycol | 5.5% by weight |
| N-2-hydroxyethyl-2-pyrrolidone | 2.5% by weight |
| Surfynol 465 | 1% by weight |
| Water (deionized water) | 76% by weight |

COMPARATIVE EXAMPLES 1 TO 3

COMPARATIVE EXAMPLE 1

| | |
|---|---|
| Glycerol | 5% by weight |
| Diethyleneglycol | 10% by weight |
| Surfynol 465 | 1% by weight |
| Water (deionized water) | 4% by weight |

COMPARATIVE EXAMPLE 2

| | |
|---|---|
| Glycerol | 5% by weight |
| Diethyleneglycol | 2% by weight |
| Surfynol 485 | 0.5% by weight |
| Water (deionized water) | 92.5% by weight |

COMPARATIVE EXAMPLE 3

| | |
|---|---|
| Glycerol | 10.5% by weight |
| Diethyleneglycol | 4.5% by weight |
| Ethyleneglycol | 5.5% by weight |
| Surfynol 465 | 1% by weight |
| Water (deionized water) | 78.5% by weight |

EXPERIMENTAL EXAMPLE 1

Missing Nozzle Pattern Test

The liquid compositions prepared according to Examples 1 to 3 and Comparative Examples 1 to 3 and distilled water were respectively used in an inkjet printer having a blade. Each liquid composition was used in the same amount. Before the test, a nozzle surface had been coated with a magenta ink and dried for 2 days. A degree of cleaning was measured using a missing nozzle detecting pattern, specifically, by counting the number of nozzles that failed to eject ink. The number of total nozzles was 760, and the number of missing nozzle patterns and a degree of ink remaining on the nozzles were measured. The results are shown in Table 1.

Assessment references: 'A' denotes the number of missing nozzles.

◎:A≦10

O:10≦A<50

X:50≦A<100

XX:100<A

EXPERIMENTAL EXAMPLE 2

Observation of Nozzle Surface

The liquid compositions prepared according to Examples 1 to 3 and Comparative Examples 1 to 3 and distilled water were respectively applied to an inkjet printer having a blade. Each liquid composition was used in the same amount. Before the test, a nozzle surface had been coated with a magenta ink and dried for 2 days.

The nozzle surface was wiped once and observed. The observation results are shown in Table 1. 'A' denotes a case in which an ink stain was substantially not present on the nozzle surface. 'B' denotes a case in which an ink stain was slightly present on the nozzle surface. 'C' denotes a case in which an ink stain was substantially present on the nozzle surface in a measurable amount. The results are illustrated in Table 1.

EXPERIMENTAL EXAMPLE 3

Nozzle Clogging Test

The liquid compositions prepared according to Examples 1 to 3 and Comparative Examples 1 to 3 and distilled water were respectively applied to an inkjet printer having a blade. Each liquid cleaning composition was used in the same amount. Cartridges were filled with cyan ink, yellow ink, magenta ink, and black ink. The filled cartridges were uncapped and left to sit for one week. Then, a maintenance process was performed on the uncapped cartridges using a wet blade function, and then a 25% solid pattern was obtained using the resultant cartridges.

The one-week uncapped cartridges were inserted to an inkjet printer and then a 25% solid pattern was printed. The results are illustrated in Table 1.Referring to Table 1, 'A' denotes a case in which when the 25% solid pattern was printed, nozzles were recovered within 100 dots. 'B' denotes a case in which when the 25% solid pattern was printed, nozzles were recovered within an A4 sheet. 'C' denotes a case in which when the 25% solid pattern was printed, at least one nozzle was not recovered within an A4 sheet.

TABLE 1

| | Number of missing nozzle patterns (the total number of nozzles is 760) | State of nozzle surface | Nozzle clogging test | | | |
|---|---|---|---|---|---|---|
| | | | Cyan | Yellow | Magenta | Black |
| Example 1 | ◎ | A | A | A | A | A |
| Example 2 | ◎ | A | A | A | A | A |
| Example 3 | ◎ | A | A | A | A | A |
| Distilled water | XX | C | C | B | C | C |
| Comparative Example 1 | X | C | B | B | B | C |
| Comparative Example 2 | X | C | B | B | B | C |
| Comparative Example 3 | ○ | C | B | B | B | B |

As illustrated in Table 1, when the liquid compositions prepared according to Examples 1 to 3 were used, no ink was present on the nozzle surface, and missing nozzle patterns were not formed. Moreover, in the one-week uncap clogging test, the liquid compositions prepared according to Examples 1 to 3 exhibited excellent recovery characteristics when nozzles were wet-wiped.

On the other hand, when distilled water and the liquid compositions prepared according to Comparative Examples 1 to 3 were respectively used, and an ink stain was not completely removed from a nozzle surface and many nozzle patterns were not formed. Moreover, in the one-week uncap clogging test, distilled water and the liquid cleaning compositions prepared according to Comparative Examples 1 to 3 showed excellent recovery characteristics when nozzles were wet-wiped.

Specifically, when distilled water was used as the liquid composition, there were many ink stains on the nozzle surface and many nozzle patterns were not formed.

Therefore, it can be seen that a cyclic amid-based compound containing liquid composition to clean a nozzle surface according to an embodiment of the present general inventive concept is effective to remove impurities from a nozzle surface of a print head.

A liquid composition to clean a nozzle surface according to an embodiment of the present general inventive concept is effective to produce a stable inkjet droplet ejection performance from an inkjet printer head when used in a maintenance process.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A liquid composition to clean a nozzle surface, the liquid composition comprising a solvent and a cyclic amide-based compound, wherein:

a content of the cyclic amide-based compound is in a range of 0.1 to 20 parts by weight based on 100 parts by weight of the liquid composition;

a viscosity of the liquid composition is in a range of 1.5 to 20 cps; and the solvent comprises a polyhydric.

2. The liquid composition of claim 1, wherein the cyclic amide-based compound is represented by Formula 1:

<Formula 1>

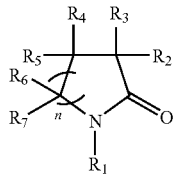

where $R_1$, $R_2$, $R_3$, $R_4$, $R_5$, $R_6$ and $R_7$ are each independently hydrogen, halogen, a carboxylic group, a cyano group, an amino group, substituted or unsubstituted C1-C20 alkyl group, substituted or unsubstituted C1-20 alkoxy group, substituted or unsubstituted C2-20 alkenyl group, substituted or unsubstituted C2-20 alkynyl group, substituted or unsubstituted C1-20 heteroalkyl group, substituted or unsubstituted C6-C30 aryl group, or substituted or unsubstituted C4-30 heteroaryl group; and n is an integer of 1 to 3.

3. The liquid composition of claim 1, wherein the cyclic amide-based compound comprises at least one compound selected from the group consisting of 2-pyrrolidone, 1-methyl-2-pyrrolidone, and N-2-hydroxyethyl-2-pyrrolidone.

4. The liquid composition of claim 1, wherein a pH of the liquid composition is in a range of 6 to 10.

5. The liquid composition of claim 1, wherein the solvent further comprises at least one compound selected from the group consisting of water, an alcohol-based solvent, a ketone-based solvent, an ester-based solvent, a nitrogen-containing solvent, dimethyl sulfoxide, tetramethyl sulfone, and a sulfur-containing compound of thioglycol.

6. The liquid composition of claim 1, wherein the solvent is a solvent mixture comprising 100 parts by weight of a water-based solvent and 0.1 to 130 parts by weight of an organic solvent.

7. The liquid composition of claim 1, wherein a surface tension of the liquid composition is in a range of 15 to 73 dyne/cm at a temperature of 20° C.

8. An inkjet recording apparatus comprising a cleaning unit containing a liquid composition to clean a nozzle surface, the liquid composition comprising a solvent and a cyclic amide-based compound, wherein a content of the cyclic amide-based compound is in a range of 0.1 to 20 parts by weight based on 100 parts by weight of the liquid composition;

a viscosity of the liquid composition is in a range of 1.5 to 20 cps; and the solvent comprises a polyhydric alcohol.

* * * * *